United States Patent [19]

McCarson

[11] 4,165,037

[45] Aug. 21, 1979

[54] APPARATUS AND METHOD FOR COMBINED SOLAR AND HEAT PUMP HEATING AND COOLING SYSTEM

[76] Inventor: Donald M. McCarson, Rte. 1, Box 143, Pisgah Forest, N.C. 28768

[21] Appl. No.: 697,941

[22] Filed: Jun. 21, 1976

[51] Int. Cl.[2] ..... F25B 13/00; F25B 25/00; F24J 3/02

[52] U.S. Cl. ..... 237/1 A; 62/238; 62/217; 62/2

[58] Field of Search ..... 62/238, 1, 2, 160, 79, 62/217, 528, 324, 200, 199; 237/1 A, 2 B; 137/487.5, 601

[56] References Cited

U.S. PATENT DOCUMENTS

| | | | |
|---|---|---|---|
| 2,106,591 | 1/1938 | Briggeman et al. | 62/200 |
| 2,575,325 | 11/1951 | Ambrose et al. | 62/238 |
| 2,619,326 | 11/1952 | McLengan | 237/2 B |
| 3,014,352 | 12/1961 | Leimbach | 62/197 |
| 3,563,304 | 2/1971 | McGrath | 62/238 |
| 3,777,508 | 12/1973 | Imabayashi et al. | 62/160 |
| 3,794,063 | 2/1974 | Carroll | 62/217 |
| 3,875,955 | 4/1975 | Gallatin et al. | 137/487.5 |
| 3,937,284 | 2/1976 | Hutton | 137/487.5 |
| 3,960,322 | 6/1976 | Ruff et al. | 62/2 |
| 3,991,938 | 11/1976 | Ramey | 237/2 B |
| 4,012,920 | 3/1977 | Kirschbaum | 62/2 |
| 4,020,862 | 5/1977 | Bohnlein et al. | 137/601 |
| 4,065,938 | 1/1978 | Jonsson | 62/238 |

*Primary Examiner*—Henry C. Yuen

*Attorney, Agent, or Firm*—Bailey, Dority & Flint

[57] ABSTRACT

A heating and cooling system is provided having an indoor heat exchanger, an outdoor heat exchanger, a refrigerant compressor, an auxiliary heat exchanger in parallel with the outdoor heat exchanger, a solar collector unit, with the auxiliary heat exchanger disposed within a fluid contained in a storage tank wherein the fluid is heated by circulation through the solar collector. Heat from the solar collector is utilized to heat an interior space as long as the temperature of the fluid is sufficient and thereafterwards the heat pump system is utilized for supplying heat as needed. When the efficiency of the heat pump system is substantially impaired due to low ambient conditions, the auxiliary heat exchanger is utilized to supplement heat capacity to the heat pump system.

27 Claims, 2 Drawing Figures

APPARATUS AND METHOD FOR COMBINED SOLAR AND HEAT PUMP HEATING AND COOLING SYSTEM

BACKGROUND OF THE INVENTION

Heretofore, many prior attempts have been made to utilize solar energy for commercial and residential heating purposes. However, many of the prior developments have not been practical or efficient in the utilization of solar energy, and considerable attention needs to be given to the problem of utilizing solar energy efficiently.

It is also recognizable that conversion from conventional heating systems to heating systems utilizing solar energy as the sole source of heat are not practical at present. Therefore, it is necessary that some efficient and practical combination of conventional and solar heating systems be utilized until technology advances to the stage where solar energy as the sole source of heat is practical.

Energy conservation requirements necessitate that solar energy be utilized as much as possible within the realm of practicality and efficiency. One form of conventional system heating system to which the application of solar energy appears attractive is the conventional heat pump system. Prior heat pump systems generally employ an outdoor heat exchanger in heat exchange relation with ambient air and an indoor heat exchanger in heat exchange with the interior space to be heated. Heat is absorbed from the outdoor air and pumped to the interior space when heating is required. The heat pump system may be operated in the reverse mode to cool the interior space during the summer time.

However, during severe winter conditions, prior heat pump systems may be unable to provide satisfactory heating due to the reduced capacity of the outdoor heat exchange coil at very low ambient temperatures. The capacity and efficiency of the heat pump system decreases as the temperature difference between the indoor and outdoor heat exchanger increases. The volumetric efficiency of the compressor becomes less as the outdoor temperature drops. In other words, when the outdoor temperature drops to a certain point, the heat pump system can no longer pump heat content from the air in an efficient manner compared to the work done by the compressor. The density of the refrigerant gas is less at lower outdoor temperatures which results in a lower volume of refrigerant being pumped and consequently a lower quantity of heat being transferred from the outdoor air.

Prior devices have been developed which utilize a supplementary source of heat to maintain the main heat source temperature at a high level to overcome the foregoing problems. Such an arrangement is shown in U.S. Pat. No. 3,563,304 wherein a first portion of the outdoor heat exchange coil is disposed in heat exchange relationship with the ambient air and a second portion of the outdoor coil is in heat exchange relationship with a pool of water. During the heating mode, the refrigerant is delivered through the first portion of the outdoor coil to absorb heat from the ambient air and then in series through the second portion of the outdoor coil where the unevaporated remainder of the refrigerant is vaporized by absorption of heat from the water in the tank. The refrigerant vapors then pass to the compressor for compressing the refrigerant. During periods of extremely cold ambient conditions, the second portion of the coil immersed in the water pool provides substantially all the heat for exchange with the interior of the house. The water in the pool from which the heat is absorbed is utilized down to the freezing point of the water, and thereafterwards the latent heat of fusion of the water is utilized as the heat source to provide heating to the building. An electrical heater is immersed in the water pool to melt any ice in the tank during periods of low power demand when rates are lower. The electrical heater raises the temperature of the water just above the freezing point. During extremely cold conditions, the first portion of the outdoor heat exchange coil is taken out of operation by de-energizing the fan which blows ambient air over the coil. However, the first portion remains in series with the second portion so that some heat is lost in the first portion.

U.S. Pat. Nos. 3,194,303 and 2,689,090 show heat pump systems which realize a supplemental heat source such as solar energy wherein a heat transfer fluid is circulated in series through a solar heat exchange coil and an underground heat exchange coil. The heat transfer fluid is then passed in heat exchange relationship with the refrigerant of the system and the heat of the fluid is transferred to the refrigerant prior to being compressed for vaporizing the refrigerant. However, the refrigerant is not pumped directly in heat exchange relationship with the heat sources and the heat exchange coils associated with the heat sources are in series.

U.S. Pat. No. 2,428,876 discloses a heat pump system having its evaporator coil immersed in a storage container having a fluid contained therein which is heated by direct solar energy. However, there is no supplemental heating coil to compensate for extended periods of cloudiness.

SUMMARY OF THE INVENTION

A heating apparatus and system is provided for heating the interior space of a building structure comprising a first heat exchange coil disposed in heat exchange relation with the interior space, and a second heat exchange coil disposed in heat exchange relationship with a main source of heat. A refrigerant flow line connects the first and second heat exchange coils, and a compressor is connected in the refrigerant line between said first and second heat exchange coil for compressing a refrigerant. The compressor has a suction side and a discharge side. An expansion means is disposed in the refrigerant line for expanding and vaporizing refrigerant in the second heat exchange coil while the refrigerant vapor is condensed in the first coil. A third heat exchange heat coil is connected in the refrigerant line in parallel with the second heat exchange coil and is disposed in heat exchange relation with an auxiliary heat source. A solar collector unit is provided for absorbing and collecting solar radiation and a fluid flow line is connected to the solar collector unit for passing a heat transfer fluid in heat exchange relationship with the solar collector. A pump means circulates the heat transfer fluid in heat exchange relationship with the solar collector means and in heat exchange relationship with the auxiliary heating source.

Therefore, it is an important object of the present invention to provide a practical and efficient heating and cooling system utilizing a combination of a heat pump system and a solar heating unit for main heating and auxiliary heating.

Another important object of the present invention is to provide an auxiliary heating unit for maintaining the effective capacity of a heat pump system during low ambient conditions.

Yet another important object of the present invention is to provide a method for heating an enclosed interior space wherein solar energy is relied upon for certain ambient conditions, a heat pump system is utilized below the ambient conditions at which the solar system is no longer efficient, and wherein an auxiliary coil immersed in an auxiliary heat source is utilized for supplementing the heat capacity of the heat pump system during low ambient conditions which render the heat pump system ineffective.

Still another important object of the present invention is to provide a heating apparatus and system having a heat pump system wherein an auxiliary heat exchange coil is connected in parallel with the outdoor evaporator coil of the heat pump system for supplementing and maintaining the effective capacity of the heat pump system.

Still another important object of the present invention is to provide a heating apparatus and system having a heat pump unit wherein the outdoor evaporator coil of the heat pump unit is supplemented in its heat capacity by an auxiliary heat exchange coil connected in parallel with the outdoor evaporator coil in heat exchange relationship with an auxiliary heating source which is heated by solar energy.

Still another important object of the present invention is to provide an auxiliary heating system for a heat pump system wherein an auxiliary heat exchange coil is connected in parallel with an outdoor heat exchange coil of the heat pump system and wherein at least a part of the refrigerant is by-passed to the auxiliary heat exchange coil when the efficiency of the outdoor heat exchange coil is reduced below a first predetermined level and wherein all of the refrigerant is directed through the auxiliary heating coil when the efficiency of the outdoor evaporator coil is reduced below a second predetermined level.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
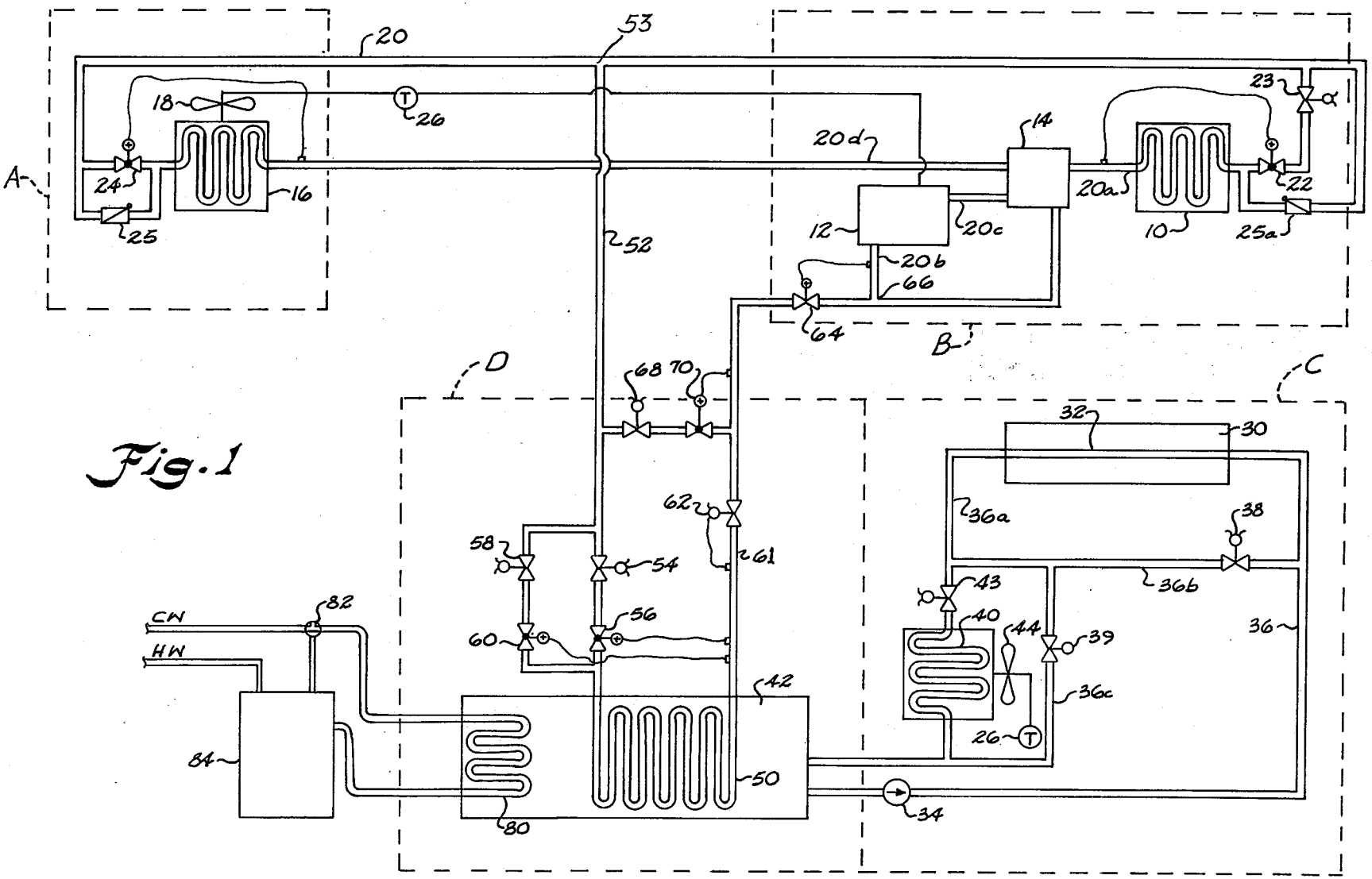
FIG. 1 is a schematic view illustrating the combined solar and heat pump system constructed in accordance with the present invention.

Referring to FIG. 1 of the drawings, the basic elements of the combination solar and heat pump heating and cooling system are as follows: a reversible heat system having an indoor unit A and an outdoor unit B, a solar heat collector and storage system C, and an auxiliary coil unit system D. The solar collector unit C and the auxiliary coil unit D may be provided in kit form to be adapted for utilization with any existing conventional heat pump system.

As is well known, a conventional heat pump system may be reversible so as to switch from heating in the winter to cooling in the summer. For the purpose of describing the elements of the heat pump system as utilized in the present invention, the operation of the heat pump will be explained in terms of its heating cycle only. It being understood that the heat pump system may be reversed to supply cooling.

The main heat pump system includes a unit B which is normally located outdoors. However, it is mainly necessary that the outdoor coil 10, which operates as an evaporator coil during heating, be located outdoors or in heat exchange relationship with the outdoor ambient air. The outdoor unit of the heat pump system also normally includes a compressor unit 12 and a reversible valve member 14 which selectively controls the heating or cooling function of the heat pump. The indoor unit A of the heat pump system includes a heat exchange coil 16 normally located in a blower housing having a fan member 18. The fan 18 blows air over the coil 16 operating as a condensor coil and heat is absorbed by the air from the heated refrigerant in the coil. The resulting heated air may then be distributed through the house by way of a conventional air duct system (not shown).

A liquid refrigerant line 20 connects the indoor condenser coil 16 with the outdoor evaporator coil 10. A refrigerant line **20*a* connects the evaporator coil 10 with the reversible valve 14. The reversible valve 14 is connected to the compressor by way of a refrigerant suction line 20*b*. The refrigerant then flows through a discharge line 20*c* back to the reversible valve 14 which then delivers the refrigerant through a line 20*d* to the indoor coil 16. The above flow directions would be for a heating cycle and the flow would be in the opposite direction for a cooling cycle wherein the reversible valve 14** would be reversed.

An expansion valve 22 is located in the refrigerant line 20 prior to passing through the outdoor evaporator coil 10 during heating. An expansion valve 24 is carried in refrigerant line 20 for expanding refrigerant through the indoor coil 16 during cooling. Expansion valve 22 provides expansion means for evaporating refrigerant in coil 10 while the refrigerant vapor is condensed in coil 16 for transferring heat from the ambient air or main heat source to the interior space to be heated. The refrigerant system line 20 may contain any suitable refrigerant such as Freon Type 22.

During heating, the expansion valve 22 expands the liquid refrigerant through the heat exchange coil 10. The liquid refrigerant absorbes heat from the coil and is vaporized changing to a gas state at a heated temperature. The gasified refrigerant then passes through the reversing valve 14 to the suction line **20*b* feeding the compressor 12. The compressor 12 compresses the gasified refrigerant to further vaporize and heat the refrigerant. The heated, vaporized refrigerant is finally delivered through line 20*d* to the condenser coil 16 whereupon the heat is transferred to the air blown over the coil for heating the interior space. A conventional thermostatic control 26** may be provided within the interior space for regulation of a desired temperature.

After leaving the condenser coil 16, the cooled refrigerant passes through a check valve 25, by-passing expansion valve 24, for delivery back to evaporator coil 10. A similar check valve **25*a* is in parallel with expansion valve 22 for by-passing valve 22** during the cooling cycle wherein reverse flows are encountered.

The solar collector and storage unit C includes a solar collector panel 30 which is preferably roof mounted but may also be mounted in any other suitable location for receiving and absorbing solar radiation from the sun. The solar collector 30 may be any conventional solar collector, such as shown in U.S. Pat. NO. 3,236,394, having an efficient solar radiation absorbing element with a high absorption factor for collecting and absorbing solar radiation. Passing through the solar collector in heat exchange relationship with the solar energy absorbing element therein is a fluid line 32 containing a suitable heat transfer fluid such as water. The water is pumped by a positive displacement pump 34 through fluid flow line 36 to the solar collector 30. A solenoid valve 38 is placed in a flow line **36*b* which by-passes solar collector 30**.

A solenoid valve 39 is placed in flow line **36*c* for by-passing a heat exchange coil 40. In the return line 36*a* is the indoor heat exchange coil 40 and a heat storage tank 42. The heat exchange coil 40 may be placed in the air duct system and is preferably in parallel with the indoor heat exchange coil 16 due to sizing and other requirements. Although a series relationship is also possible. The operation of heat exchange coils 16 and 40** will be more fully explained later.

A solenoid valve 43, operated in response to the temperature of the heat transfer fluid, provides means for delivering the fluid through the coil 40 when the fluid temperature is above a predetermined level such as ninety-five degrees. Air is blown over the heat exchange coil 40 by a blower member 44 which may be controlled by thermostat 26. The fluid flowing in the line 36 and through the solar collector 30 will be heated by solar radiation therein. The heat from the fluid will then be transferred by the heat exchange coil 40 to the air blowing thereover for heating the interior of the house as required by the thermostat 26.

The storage tank 42 may be located in any suitable location such as will enhance the insulation and storage of the heated fluid contained therein. In a preferred embodiment the storage tank 42 may be located in or underneath the flooring of the basement or underneath any other main flooring of the housing. Underground installation would enhance the insulation of the heated fluid contained therein. However, it is to be understood, that other forms of insulated storage containers may be effectively utilized for storing the heated fluid. The fluid is preferably water in solution with an antifreeze additive.

Referring now to the auxiliary coil unit D, an auxiliary heat exchange coil 50 is shown immersed in the heat transfer fluid contained in the storage tank 42. A parallel refrigerant by-pass line 52 connects at junction 53 with main refrigerant line 20 and by-passes part of the refrigerant flowing in line 20 to the auxiliary evaporator coil 50. The refrigerant delivered through line 52 passes through a solenoid valve 54 and a thermal expansion valve 56. A parallel path for the flow of the refrigerant in line 52 is provided by a solenoid valve 58 and thermal expansion valve 60.

Preferably, the expansion valve 60 is of the same size and capacity as expansion valve 22 and expansion valve 56 has a reduced capacity of approximately fifty percent of that of expansion valve 60. Valves 56 and 60 are preferably conventional thermostatic expansion valves.

The expansion valve 56 is sized to utilize only part of the heat exchange capacity of coil 50 whereas valve 60 is sized to utilize the full capacity of coil 50. Normally, only the partial capacity of coil 50 is needed to supplement the outdoor coil 10. However, under extremely cold ambient conditions coil 10 may be rendered ineffective in extracting outdoor heat. Under such conditions, the expansion valve 60 and the full capacity of coil 50 may be required.

Any of the operating conditions of outdoor coil 10 may be sensed to indicate its capacity to exchange heat such as outdoor air temperature, refrigerant line temperatures and pressure, etc. The solenoid valves 54 and 58, providing flow control means, may then be opened and closed as required by the sensed conditions in a conventional manner. Of course, both valves are closed as long as outdoor coil 10 has the capacity to heat the interior space efficiently which again will depend on the coil design and operating parameters, as well as the heat loss characteristics of the structure being heated.

Under certain heating conditions, the refrigerant is expanded through the expansion valve 56 and the evaporator coil 50 whereupon the refrigerant absorbs heat from the stored heat in the water surrounding coil 50 and changes to a heated vapor or gas. The expanded and gasified refrigerant would then flow through refrigerant line 61, evaporator pressure regulator valve 62, and crankcase pressure regulator (CPR) valve 64 to a junction point 66. At this point, the refrigerant in line 61 would combine with the refrigerant in line **20*b* flowing from the main evaporator coil 10 to enter the compressor 12. The crankcase pressure regulator valve 64 regulates the pressure in the compressor suction line 20*b* such as at point 66** to prevent the compressor from being overloaded with vapor.

In some instances of operating with partial capacity valve 56, the refrigerant may vaporize such as half-way through coil 5 and thereafter continue to absorb heat. Thus, the vapor will enter line 61 in a superheated condition. This can result in the compressor being overheated due to increased temperature of the refrigerant vapor. Therefore, a liquid refrigerant injection system is provided by solenoid valve 68 and thermal expansion valve 70 for cooling and de-superheating the superheated vapor when it exceeds a certain temperature as it leaves the discharge side 61 of the auxiliary evaporator coil 50. The valve 68 and expansion valve 70 are connected across the coil 50 in parallel therewith. The solenoid valve is opened in response to the superheated conditions.

The operation of the system in accordance with the present invention will now be explained in more detail for heating the interior space of a building structure such as a residential dwelling. It is to be understood, of course, that the various design and operational conditions of temperature and pressure are given for purposes of illustration only and not for limitation thereto. The operational temperatures and pressures of the various elements of the system will depend on the particular heat pump design and capacity being utilized, outdoor climate conditions, structural design of the dwelling, and other various factors in the particular application being made.

As long as the water or other heat transfer fluid stored in the storage tank 42 is at a temperature which can satisfy the heating requirements for the interior space, such as ninety-five degrees farenheit (F) or higher, solenoid valve 43 will be open with valves 38 and 39 closed. Water will be continuously circulated by pump 34 through the line 36, the solar collector 30, and the heat exchange coil 40. As the heated water passes through the heat exchange coil 40 the fan 44 will blow the air to be heated over the coil to abosrb the heat therefrom. The heated air may then be distributed throughout a conventional duct distribution system for heating as the house thermostat calls for the operation of fan 44 in a conventional manner. In this manner, the heating for the interior of the dwelling shall be provided by solar energy as long as the water storage temperature is adequate.

If for example, the water is maintained at a temperature of ninety-five degrees, it is possible to maintain the interior of the dwelling heated to approximately seventy-five degrees accounting for a normal twenty-degree temperature loss. Such would be sufficient for most interior heating spaces at least while the sun is shining sufficiently to maintain the water in storage tank 42 at ninety-five degrees.

In the event the outdoor or collector temperature is less than the temperature of fluid stored in 42, as can be sensed with a conventional differential thermostat, then solenoid 38 is open to by-pass solar collector 30. The heated fluid from 42 is still circulated through 43 and 40 as long as the heat thereof is sufficient for supplying heat to the interior space.

With solenoid 38 closed, solenoid 43 closed and solenoid 39 open, fluid may be circulated through heat collector 30 directly to storage tank 42. This may be desired when temperature in 42 is less than ninety-five degrees but the outdoor temperature is still greater than that in tank 42.

At such time as the water temperature in storage tank 42 becomes inadequate to satisfy the heat requirements the house thermostat 26 then calls for heat pump operation. At that time, the heat pump system will operate to transfer heat from the outside air through heat exchange coil 10 to the interior space of the house through the indoor condenser coil 16 until the desired indoor temperature is reached.

If, however, the outdoor temperature drops sufficiently so that the efficiency of the outdoor heat exchange coil 10 is reduced and impaired, such as below forty to thirty-five degrees F., the axuiliary evaporator coil 50 immersed in the storage tank 42 will be put into operation to supplement the outdoor evaporator coil 10 to maintain the heat pump operation at maximum efficiency. In this instance solenoid valve 54 will be switched open allowing refrigerant to flow and expand through partial capacity expansion valve 56 and evaporator coil 50.

Under certain conditions of severe coldness such as when the outdoor air temperature is in the range of zero-five degrees F., the capacity of the outdoor evaporator coil 10 may be substantially reduced to the point of being ineffective as a heat exchanger. Under such conditions, solenoid valve 58 may be opened with valve 54 closed to allow refrigerant to flow and expand through full capacity expansion valve 60, which preferably has about twice the expansion capacity of parallel valve 56.

In this instance, when it is no longer practical to operate outdoor coil 10, the temperature responsive solenoid valve 23 will close off the flow of refrigerant line 20 through the coil 10. Thus, a full flow of refrigerant is delivered through parallel refrigerant line 52, with coil 10 being totally by-passed.

With the auxiliary evaporator coil 50 immersed in heat storage tank 42 operating at full or increased capacity, sufficient heat may be absorbed from the water to heat the interior space even when severe coldness exists outside. For example, as a rule of thumb, a seventy degree F. interior temperature may be maintained by the heat pump unit using only outdoor coil 10 when the outdoor air temperature is twenty-five to thirty degrees F. Although operation under such conditions may be inefficient. At the same time, the water temperature in tank 42 may be fifty to seventy degrees F., so that approximately twice as much heat content is available. Also, the solar collector unit C will be adding heat to tank 42 if the sun is shining. So that adequate heat capacity would probably be stored in tank 42 even for sub-zero ambient temperatures.

Of course, the amount of heat that can be stored in the storage tank 42 depends on several factors such as the size of the tank and the amount of insulation provided. When utilizing the full capacity of auxiliary evaporator coil 50, it is possible to extract heat from the water in the tank 42 right down almost to the freezing point of the water. In this instance, it is desirable to provide means for preventing the water from freezing. This may be accomplished in a number of ways but preferably by providing an anti-freeze solution.

In addition, the evaporator pressure regulator valve 62 will be responsive to the pressure of refrigerant in coil 50 and line 61, and thus to the temperature of the refrigerant, to maintain the temperature of the solution above its freezing point. In other words, the compressor 12 is operating at such a capacity to cause evaporator coil 50 to extract heat from the solution to a point below the freezing point of the solution. In such instance, the pressure evaporator regulator valve 62 will sense the resulting pressure or temperature drop in the refrigerant going to the compressor. Under these conditions, the evaporator pressure regulator 62 will throttle the flow of refrigerant through line 61 to the compressor and prevent the compressor from lowering the pressure in the evaporator coil 50 and hence the temperature of the solution in tank 42, below a freezing point.

When using auxiliary coil 50, particularly in combination with outdoor coil 10, it is necessary to control or limit the pressure in the suction line 20*b* of the compressor inlet to prevent overloading the capacity of the compressor. Two means are provided for doing this.

First, crankcase pressure regulator valve 64 may be set to limit the pressure in suction line 20*b* to a desired pressure by throttling and closing off flow from evaporator coil 50. This flow will be throttled in line 61, even when solenoid 54 or 58 is opened, if excess pressure is caused by vapor flowing from coil 50. Excess pressure will normally not be caused by vapor flowing from outdoor coil 10 since this coil is normally pre-designed to operate only up to the capacity of the compressor 12. Second, the reduced size of expansion valve 56 limits the amount of refrigerant delivered through coil 50 during the supplemental heat mode of operation.

It is also necessary and desirable to limit the operating capacity of auxiliary 50 when operating in the supplemental heat mode so that vapor pressure from coil 50 does not override coil 10. Since the rate of evaporation decreases in an evaporation coil as the pressure in the coil increases, the pressure in coil 10 may be increased by an excessively high pressure of vapor discharged from coil 50 and hence the rate of evaporation decreased in coil 10. In this condition, coil 10 may not be able to extract any heat from the ambient outdoor air and may be flooded with liquid refrigerant. This condition occurs owing to the fact that the heat content of fluid in tank 42 is greater than the heat available in the outside air.

If the pressure of vapor discharged is allowed to increase without limit, the pressure and hence temperature at the discharge of coil 10 will be elevated and the thermostatic expansion valve 22 will open to expand even more refrigerant. Since the rate of evaporation has been decreased in the coil due to the increase of pressure, complete flooding out of coil 10 can occur.

The heat content of the outdoor air will be lost, if not used, whereby heat in the storage tank 42 can be stored more readily. Thus, it is desirable to extract as much of the heat content out of the outdoor air as possible and store as much heat in tank 42 as possible while supplementing the heat capacity of coil 10 with auxiliary coil 50 without flooding coil 10.

For reducing the problems of coil flooding and nonutilization of outdoor air heat content, a reduced or partial operating capacity is provided for the auxiliary coil 50 by the reduced size of expansion valve 56. The coil 50 will supplement outdoor coil 10 in a reduced capacity when operation with valve 56. The expansion valve 56 is preferably sized to expand refrigerant and utilize approximately one-half the heat exchange capacity of the auxiliary coil 50. The expansion valve 60 would then be sized to utilize the full capacity of coil 50.

The valve 56 is preferably sized in accordance with the capacities of evaporator coils 10 and 50 and the particular heat pump system being utilized so that for the particular range of outdoor and indoor temperature conditions, under which application is made, the reduced capacity of coil 50 will not likely override the capacity of coil 10. Of course, when the outdoor temperature reaches a critically low temperature where coil 10 is rendered ineffective, the refrigerant will flow through parallel expansion valve 60 having full capacity.

The solenoid valve 54, which controls the flow of refrigerant through expansion valve 56 during conditions requiring auxiliary heat, is preferably switched in response to pressure in the suction line **20*b*. The pressure (P1) would correspond to a first predetermined level of outdoor temperature (TP1), depending on the heat pump system design, below which the effectiveness of coil 10 as a heat exchanger becomes reduced below a desired predetermined level of efficiency. At this pressure set point, solenoid 54 would be open and 58 closed with refrigerant being delivered through valve 56 to supplement the capacity of coil 10. If the pressure in suction line 20*b* rises above this set point, then solenoid 54 would close taking auxiliary coil 50** out of operation until suction line pressure again drops below the set point.

The pressure P1 is preferably sensed with a conventional pressure switch (PS1) having an adjustable pressure differential. One suitable switch is manufactured by Penn Controls Co. as single pole-double throw switch no. P 72AA-1 having an adjustable differential range of 6 to 70 psi. Once the pressure drops below P1, the contacts of the switch will close, opening solenoid valve 54, and the contacts will not reopen until the pressure increases above the selected pressure differential. In the preferred embodiment, the pressure switch PS1 is set with a 20 psi differential. This pressure differential is required for preventing rapid cycling on and off of solenoid 54 which would otherwise occur.

When valves 54 and 56 are initially opened in response to a pressure drop below P1, the pressure will almost immediately build back up to a point above P1. Without a pressure differential provided for in the pressure switch PS1, the solenoid would be immediately switched off.

For example, assume P1 is set at 32.8 psi corresponding to an outside air temperature of thirty-five degrees F. Normally, a heat pump will operate with a twenty-five (25) degree temperature differential between the air across the coil and the refrigerant in the coil. Thus, the refrigerant in the coil will be at about ten (10) degrees F. When suction line pressure drops below 32.8 psi, the auxiliary coil 50 is put into operation. However, coil 50 is allowed to operate until pressure exceeds 52.8 psi wherein pressure switch PS1 is set with a 20 psi differential. Due to the limiting affect of the reduced size of expansion valve 54, the pressure of vapor discharged from coil 50 will not likely override coil 10 during the supplemental heat mode.

If the pressure exceeds 52.8 psi, auxiliary coil 50 will be taken out of operation so that the critical flooding of coil 10 is prevented. Buildup of pressure beyond this point will normally mean that the capacity of coil 10 does not need to be supplemented.

After solenoid 54 closes valve 56 and coil 50 will be taken out of operation. The vapor remaining in discharge line 61 will of course continue to be drawn off by the compressor unless CPR valve 64 has closed line 61 completely owing to pressures above its set point. After the suction pressure in **20*b* again drops below P1, solenoid 54 will be switched open permitting refrigerant expansion through valve 56 and coil 50. Since pressure and hence temperature in discharge line 61 will have been reduced due to the drawing off of the remaining vapor, conditions will be favorable for expansion through valve 54. The rate of evaporation in coil 50** will be increased due to pressure decrease in the coil.

The above cyclic operation of solenoid 54 and expansion valve 56 will not be rapid nor of a high frequency due to the pressure differential operation of switch PS1. Furthermore, the outdoor temperature will not vary that rapidly. When the outdoor temperature drops below the temperature corresponding to P1, it may be a period of many hours before it rises above this point. Niether will the temperature of heat source 42 vary greatly. Thus, the pressure in the coils and suction line **20*b* will not vary that rapidly. Of course, above P1, solenoid 54 and valve 56** will remain off as supplemental heat is not necessary. The basic heat pump system itself will not be operating continuously.

It is to be understood, of course, that the temperature of vapor in suction line **20*b* may be sensed instead of pressure. Pressure being preferred owing to the convenient and accurage sensing by a conventional pressure switch providing efficient control of solenoid 54**.

If a more precise blending of the vapor from the two coils 10 and 50 is required, a pressure differential switch may be utilized to control solenoid 54. Thus, instead of sensing a single pressure, the pressure in the coil discharge lines **20*a* and 61 may be sensed. In this manner, expansion valve 56 would operate only when the vapor pressure from coil 50 is less than that from coil 10. The utilization of the heat exchange capacity of coil 10** would be insured without flooding.

Solenoid 58 is switched open with solenoid 54 switched closed in response to the outdoor ambient air reaching a second predetermined level (TP2) corresponding to the point at which the heat exchange capacity of coil 10 is reduced substantially to zero. This point of course, depends primarily on the coil and heat pump system design, and the indoor heating requirements as well as the climate conditions.

With solenoid 58 open, refrigerant is expanded through full capacity expansion valve 60 utilizing the full heat exchange capacity of coil 50. Also at this second predetermined temperature level, solenoid 23 is closed taking coil 10 out of operation in the system. Thus, the heat pump system operates solely from the auxiliary heat source 42. Solenoid 58 may be controlled by a pre-set outdoor temperature level since coil 10 is not operating and no blending or limiting of vapor is required.

An example of operating levels is that P1 would correspond to a first predetermined outdoor temperature level of (TP1) thirty-five degrees (F.) and TP2 would be preset at five degrees (F.).

It is to be understood, of course, that additional expansion valves of predetermined sizes could be placed in parallel with expansion valves 56 and 60 to provide a more continuously variable capacity for the auxiliary coil 50. Thus, the two vapor flows from coils 10 and 50 could be more equally blended for compression. Other suitable valve arrangements may also be utilized for equalizing pressures between the two coils to allow blending of vapor and extracting of heat while preventing flooding of the outdoor coil during auxiliary coil operation.

The important object is to keep the flow from coil 50 modulated so that the pressure of vapor refrigerant does not elevate the pressure in the compressor suction line to the point that coil 10 is no longer able to extract heat from the outdoor air. It is desirable to have some heat picked up from each coil unit. As long as coil 10 is able to supply some heat, flow from coil 50 sould be equalized so that it doesn't take precedence over vapor flow from coil 10 and cause the flooding thereof. When flow from coil 50 is held back, the heat will not be lost as it would be in coil 10, but is stored in tank 42.

Since expansion valve 56 delivers a reduced flow of refrigerant through coil 50 compared to its full capacity, it is possible that some refrigerant will be evaporated by the time it is half way or so through the coil. Thereafter, the vapor will continue to pick up heat as it continues through the coil resulting in superheated vapor flowing out of the coil. In the event that the vapor refrigerant is superheated above the limitations of the compressor 12, the solenoid 68, which is responsive to the predetermined superheat conditions, will be opened. This allows valve 70 to inject liquid refrigerant from line 52 into the suction line 60 to cool the superheated vapor. The valve 70 may be a conventional thermostatic expansion valve or a fixed capilliary tube arrangement.

During operation of auxiliary coil 50, if the pressure at 66 should exceed the limit of crankcase pressure regulator valve 64, then flow in line 61 would be throttled back by valve 64. Once the pressure falls below the pressure limit then refrigerant would flow again in line 61.

To provide heating for periods of very extenuated cold weather with little or no sunshine, and in areas having very cold climates, it may be necessary to have an emergency heating source. To this end, a set of electric heating coils may be placed in the air duct distribution system for direct heating of the air. Such could be manually or thermostatically controlled. The electric coils would operate only when the heat pump coils 10 and 50 are rendered effective under the above conditions.

During the summer months when cooling is required, cooling capacity can be stored in tank 42 by cooling the liquid contained therein during off-peak load hours when there is a reduced demand for electricity. During this mode of operation; the heat pump system may be run in the cool cycle with indoor coil 16 bypassed completely by flow through auxiliary coil 50, and with indoor coil 16 being out of operation as a condensor due to deactuation of fan 18. In this instance, heated fluid from solar collector 30 will not be delivered to tank 42.

During the cooling cycle of the heat pump system, the auxiliary coil will not normally be utilized as a condensor coil. However, if cooling capacity is stored in tank 42, it will then be desirable to circulate refrigerant through coil 50 to be condensed for exchanging heat with the cooled fluid.

It may be desirable to not cool the fluid in tank 42 during the summer, but to leave the fluid heated for use in heating the domestic water supply during such time. To this end, a coil 80 may be disposed in heat exchange relation with the fluid contained in tank 42. A three-way valve 82 may be operated in response to the fluid temperature for circulating domestic water selectively either through coil 80 for heating or to a conventional domestic water heater 84 for heating. Of course, coil 80 may be utilized to heat domestic water in the winter months as well.

Figure 2:
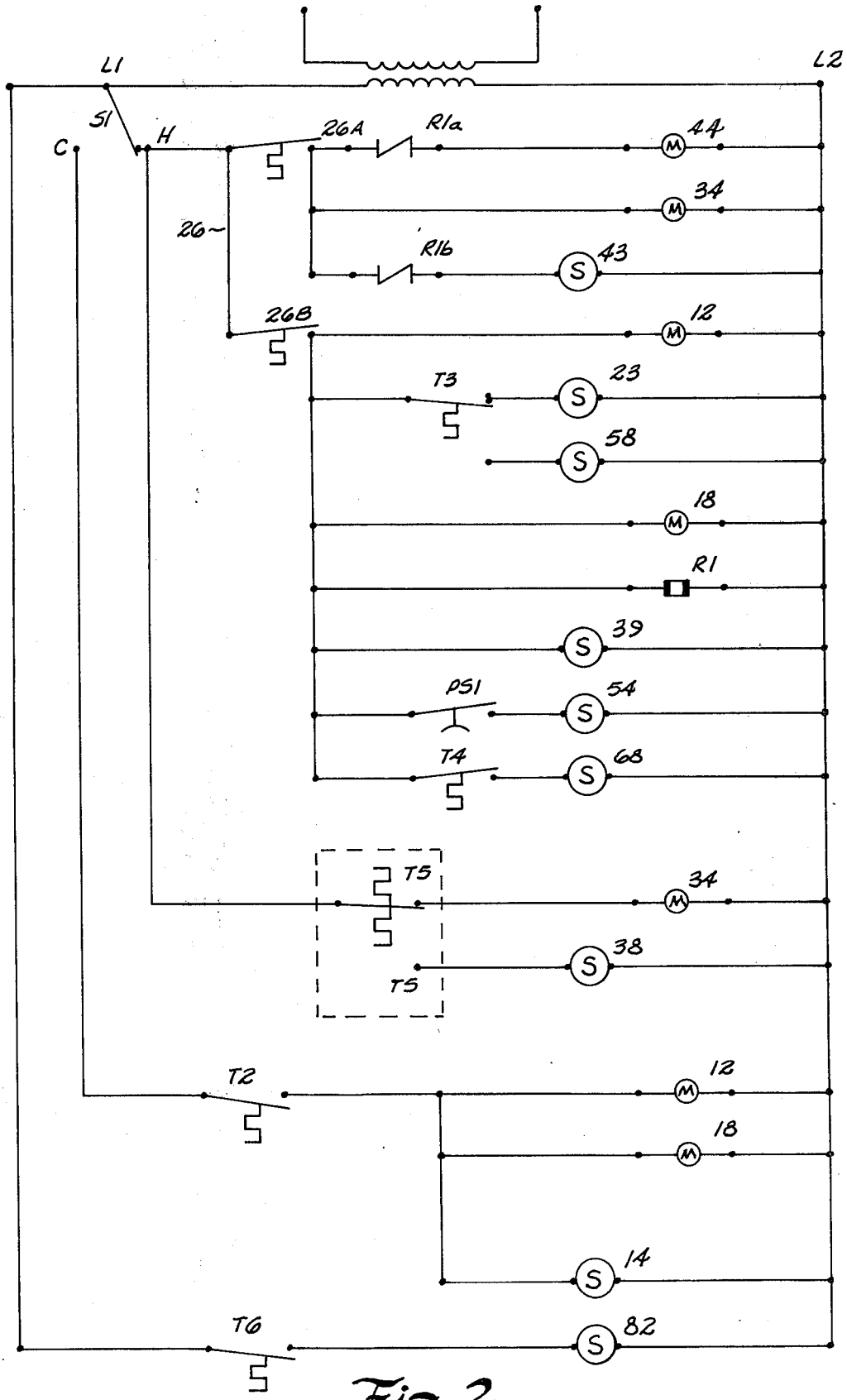
FIG. 2 is a schematic diagram of an electrical control circuit which may be utilized to control the system of the present invention.

Any suitable control circuit may be utilized for controlling the apparatus and method of the present invention. FIG. 2 of the drawings illustrates one example of a suitable control circuit. The control circuit includes a pair of low voltage control lines L1 and L2 such as found in a conventional thermostatic control circuit for heating and cooling. The elements of the control circuit which are connected generally between the two lines L1 and L2 are embodied in the thermostat shown schematically at 26 having two steps or stages *26a* and *26b*. The circuit elements are described briefly as follows. S1 is a selector switch for selecting either cooling or heating operations for the interior space to be heated or cooled. The thermostat stages *26a* and *26b* are conventional thermostatic elements. The first step *26a* controlls the heating requirements for the interior space when utilizing the solar collector heating system enclosed in block C. The second stage *26b* controls the heating requirements when utilizing the heat pump system A and B and the auxiliary system D. The various solenoid valves which control the flow of refrigerant and other fluid in the heating and cooling system are found in the control circuit and correspond to the solenoid valves as shown in FIG. 1. The solenoid valves shwon are in a normally closed condition unless energized as shown in the control circuit of FIG. 2.

Elements 44 and 18 are the fan motors for fan 44 and 18, respectively. Elements 34 and 12 are the electrical motors for the water pump 34 and compressor 12, respectively. R1 is a conventional relay having normally closed contacts R1*a* and R1*b*. Element 14 is the reversing valve shown in FIG. 1 for reversing the heat pump system from a heating to a cooling cycle and vice versa.

T2 is the thermostat element for the cooling cycle. T3 is the thermostat for sensing outdoor air temperature. T4 is the thermostatic element for sensing the temperature of refrigerant in line 60 for controlling solenoid valve 68 and thus liquid injection expansion valve 70. T5 is a differential thermostat for sensing the difference in temperatures between the outdoor air or solar collector temperature and the temperature of the fluid in storage tank 42. T6 is the control thermostat for the domestic hot water system. P1 is the pressure switch which controls solenoid 54 and senses the pressure in the compressor suction line 23. All of these elements are, of course, conventionally mounted in the proper location for detecting the respective operation parameters.

Referring now to FIGS. 1 and 2, the operation of the system will be set forth briefly in reference to the control circuit in FIG. 2. Assuming that the selector switch S1 has been set on the heating position H and heating is required by the interior space of the house, thermostatic element 26A will be closed energizing fan motor 44, pump 34 and opening solenoid 43. Thus, heated fluid will be circulated through the flow line 36, the heat collector 30 and the heat exchange coil 40 with the solenoid valves 38 and 39 remaining closed.

As long as the solar collector unit C can satisfy the interior heating requirements, the first stage 26A will operate to cycle the blower 44 on and off. The thermostat 26 will sense a falling interior temperature when the temperature requirements can no longer be met, and will call for a second stage heating operation through closing second stage contact 26B.

When the first stage can no longer satisfy the heating requirements of the interior space, the second stage thermostat 26B will close energizing the compressor 12, indoor fan motor 18, relay R1 opening the contacts R1*a* and R1*b* to stop fan 44 and close solenoid 43. Pump 34 will remain energized and the solenoid valve 39 is also energized during this stage so that heat transfer fluid circulating in line 36 by-passes heat exchange coil 40 through solenoid valve 39. Only the outdoor heat exchange coil 10 will be operating in the second stage heating mode until the pressure switch PS1 closes. Thermostat stage 26B will operate to cycle compressor 12 and blower 18 on and off to satisfy interior heating requirements.

Pressure switch PS1 closes when it senses a suction line pressure corresponding to an outdoor temperature of below thirty-five degrees. With pressure switch PS1 closed solenoid 54 will be energized and part of the refrigerant flow will be delivered through expansion valve 56 and auxiliary heat exchange coil 50.

If the outdoor temperature drops below T3 which is the temperature at which the heat exchange capacity of the outdoor coil 10 is reduced substantially to zero, solenoid 23 will be de-energized and thus closed making the outdoor heat exchange coil 10 out of operation. Also, solenoid 58 will be energized delivering the refrigerant through the full capacity expansion valve 60 and the auxiliary heat exchange coil 50. The discharge pressure of coil 50 operating at full capacity will normally be above P1 so that valve 54 will be closed.

It is to be remembered that all of the above second stage heating operations are undergone only when heating is required in the interior space as sensed by the thermostatic element 26B.

Thermostatic element T4 is always sensing the temperature in discharge line 61 to maintain a safe suction temperature at compressor 12. Should temperature T4 be exceeded in discharge line 61, solenoid 68 will be energized to inject liquid refrigerant through expansion valve 70 into the line to lower the temperature.

While the selector switch S1 is set on the heating contact H, various elements of the solar collector unit C are always operating in the following manner. Differential thermostat T5 acts to energize control pump 34 and solar by-pass solenoid valve 38 to collect heat from the solar collector 30 when the outdoor solar collector panel temperature is greater than the temperature of the heat transfer fluid in tank 42.

Evaporator pressure regulator valve 62 and crankcase pressure regulator valve 64 are always operating during the second stage of operation, however, they are not controlled by the control circuit of FIG. 2.

When the selector switch S1 is set to the cooling position denoted by C, reversing valve 14 is reversed for cooling, and thermostat T2 cycles compressor 12 and fan motor 18 as required for interior cooling.

Thermostatic element T6 controls three-way valve 82 to deliver water for domestic heating through the heat exchange coil 80 only when the temperature of the heat transfer fluid in tank 42 is above a predetermined temperature.

The advantages in using solar energy as an auxiliary heat source in accordance with the present invention are now made more fully obvious. Prior systems which have been proposed for heating, such as for residential structures, have required the installation of solar collector panels over a substantial area of the roof structure and a rather large storage tank for storing the collected heat. These requirements have produced cost factor problems and aesthetic problem with interior and exterior design. The auxiliary heat unit of the present invention can provide approximately the same amount of heat from solar energy as the prior systems but with only half the panel and storage size requirements. This is so because the stored heat in tank 42 is usable down to a much lower temperature than in storage tanks of the prior systems wherein the interior air was circulated directly over or through the heat storage chamber.

Thus auxiliary heat exchange coil 50 may use stored heat in tank 42 down to a lower temperature such as twenty degrees F., whereas prior storage chamber systems are normally not usable below ninety degrees F. for maintaining seventy degree interior temperature. The only limitation in the present system, is the freezing point of the liquid solution in tank 42. The heat stored in tank 42 has approximately twice the usable range of the prior storage systems and presents a practical and economical utilization of solar energy when combined with a heat pump system in accordance with the present invention.

While a preferred embodiment of the invention has been described using specific terms, such description is for illustrative purposes only, and it is to be understood that changes and variations may be made without departing from the spirit or scope of the following claims.

What is claimed is:

1. A heating system for delivering heat to the interior space of a building structure comprising:

a first heat exchange coil disposed in heat exchange relationship with said interior space;

a second heat exchange coil in heat exchange relationship with a main heat source;

a fluid refrigerant line connecting said first and second heat exchange coils having a fluid refrigerant contained therein;

a compressor means connected in said refrigerant line between said first and second heat exchange coils having a suction side and a discharge side for compressing said refrigerant;

a third heat exchange coil connected in a parallel flow relationship with said second heat exchange coil in a parallel refrigerant line and in a series flow relationship with said compressor means, said third heat exchange coil being in heat exchange relationship with an auxiliary heat source;

expansion means connected in said refrigerant line for evaporating refrigerant in said second heat exchange coil, said refrigerant vapor being condensed in said first heat exchange coil for transferring heat from said main heat source to said interior space;

valve means connected in said parallel refrigerant line for selectively by-passing and expanding at least a part of said refrigerant through said third heat exchange coil as required for satisfying the heating requirements of said interior space; and means combining refrigerant flow from said second and third heat exchange coil prior to entering said suction side of said compressor means affording regulation of said flow from said second and third heat exchange coils so as to efficiently utilize the heat available from said main heat source in combination with heat from said auxiliary heat source.

whereby the heat capacity of the heating system is effectively maintained for low outdoor temperature conditions.

2. The system set forth in claim 1 wherein said valve means comprises a full capacity expansion means and a reduced capacity expansion means through which said refrigerant may be selectively expanded in response to the heat exchange capacity of said second heat exchange coil being reduced.

3. The system set forth in claim 2 wherein said full capacity expansion means and said reduced capacity expansion means are connected in said by-pass refrigerant line in parallel.

4. The system set forth in claim 2 wherein said valve means further comprises flow control means for delivering refrigerant through said reduced expansion means when the heat exchange capacity of said second coil is reduced below a first predetermined level and for delivering refrigerant through said full capacity expansion means when the heat exchange capacity of said second coil is reduced below a second predetermined level.

5. The system set forth in claim 1 further comprising injection valve means connected in parallel across said third coil for injecting liquid refrigerant into vaporized refrigerant discharged from said third coil for cooling said vaporized refrigerant when discharged in a superheated condition.

6. The system set forth in claim 1 further comprising a pressure regulator valve connected in said refrigerant line on the suction side of said compressor for regulating the flow of refrigerant from said third coil so as to protect the compressor from being overloaded.

7. The system as set forth in claim 1 further comprising evaporator pressure regulator means connected in said parallel refrigerant line for regulating the pressure of refrigerant in said third heat exchange coil so as to prevent the lowering of the temperature of said auxiliary heat source below a critical level.

8. The system as set forth in claim 7 wherein said auxiliary heat source is a heat transfer liquid and said critical level is defined by the freezing point of said liquid.

9. The system set forth in claim 1 including cut-off valve means for terminating refrigerant flow through said second heat exchange coil when the heat exchange capacity thereof is reduced below a predetermined limit.

10. A heating apparatus and system for heating the interior space of a building structure comprising a first heat exchange coil disposed in heat exchange relation with said interior space, a second heat exchange coil disposed in heat exchange relationship with a main source of heat, a refrigerant flow line connecting said first and second heat exchange coils, a compressor connected in said refrigerant line between said first and second heat exchange coil for compressing said refrigerant, said compressor having a suction side and a discharge side, and expansion means disposed in said refrigerant line for expanding and vaporizing refrigerant in said second heat exchange coil, said refrigerant vapor being condensed in said first coil; the improvement comprising a third heat exchange heat coil connected in said refrigerant line in parallel with said second heat exchange coil and in series with said compressor, said third heat exchange coil being disposed in heat exchange relation with an auxiliary heat source, said second and third heat exchange coils being connected in common series flow prior to entering said compressor affording regulation of said flow so as to efficiently supplement heat from said auxiliary heat source in combination with heat from said main heat source as required to maintain the heating capacity of said system; solar collector means for absorbing and collecting solar radiation, a fluid flow line connected to said solar collector means for passing a heat transfer fluid in heat exchange relationship with said solar collector means, and pump means for circulating said heat transfer fluid in heat exchange relationship with said solar collector means and in heat exchange relationship with said auxiliary heating source.

11. The apparatus and system set forth in claim 10 further comprising a fourth heat exchange coil disposed in heat exchange relation with said interior space connected in said fluid flow line.

12. The apparatus and system set forth in claim 11 further comprising valve means connected in said fluid flow line for selectively delivering said heat transfer fluid through said fourth heat exchange coil.

13. The apparatus and system set forth in claim 12 further comprising blower means for delivering air over said fourth heat exchange coil to transfer heat from the fluid flowing therein to said interior space as heating is required therein.

14. The apparatus and system set forth in claim 10 further comprising a second expansion means connected in said refrigerant line for expanding refrigerant through said third heat exchange coil as it absorbs heat from said auxiliary heat source to vaporize said refrigerant.

15. The apparatus and system set forth in claim 14 wherein said second expansion means includes a full capacity expansion means and a reduced capacity expansion means through which refrigerant may be selectively expanded, and wherein flow control means are connected in said refrigerant line for selectively expanding said refrigerant through one of said expansion means in response to the heat exchange capacity of said second heat exchange coil being reduced for supplementing the total heating capacity of the system.

16. The apparatus and system set forth in claim 10 further comprising valve means connected in said refrigerant line for by-passing and expanding at least a part of said refrigerant through said third heat exchange coil in response to the heat exchange capacity of said second heat exchange coil being reduced below a predetermined level.

17. A method for maintaining the effective heating capacity of a heat pump system having a first heat exchange coil disposed in heat exchange relation with an area to be heated, a second heat exchange coil disposed in heat exchange relationship with a main heat source, a refrigerant flow line connecting said first and second heat exchange coils having a fluid refrigerant contained therein, a compressor having a suction side and a discharge side connected in said refrigerant line between said first and second coils for compressing said refrigerant, expansion means disposed in said refrigerant line for expanding and vaporizing refrigerant in said second heat exchange coil, said vaporized refrigerant being condensed in said first heat exchange coil for transferring heat from said main heat source to said area to be heated; said method comprising the steps of:

providing a third heat exchange coil in parallel flow relationship with said second heat exchange coil connected in a parallel refrigerant line;

providing an auxiliary heating source and disposing said third heat exchange coil in heat exchange relationship with said auxiliary heating source;

by-passing at least a part of said refrigerant through said parallel refrigerant line and expanding said by-pass refrigerant through said third heat exchange coil in response to the heat exchange capacity of said second heat exchange coil with said main heat source being reduced below a predetermined level; and combining and controlling said refrigerant flow from said second and third heat exchange coils prior to entering said compressor to efficiently supplement heat from said auxiliary heat source in combination with heat from said main heat source.

18. The method as set forth in claim 17 wherein said auxiliary heating source is provided by a storage container, a heat transfer fluid contained in said storage container having a capacity for storing heat, and heating said heat transfer fluid by bringing said heat transfer fluid into heat exchange contact with a heat source.

19. The method as set forth in claim 18 wherein said heat source is a solar collector for collecting and absorbing solar radiation.

20. The method as set forth in claim 16 further comprising the steps of:

providing a partial capacity expansion means and a full capacity expansion means connected in said by-pass refrigerant line in a parallel relationship;

expanding said by-passed refrigerant through said partial capacity expansion means in response to the heat exchange capacity of said second coil being reduced below a first predetermined level; and expanding said by-pass refrigerant through said full capacity expansion means in response to the heat exchange capacity of said second heat exchange coil being reduced below a second predetermined level.

21. The method as set forth in claim 17 further comprising the step of providing an injection valve means in parallel across said third heat exchange coil for injecting liquid refrigerant into the vaporized refrigerant discharged from said third exchange coil in response to said vapor being discharged in a superheated condition for cooling and desuperheating said vapor.

22. The method as set forth in claim 17 further comprising providing a pressure regulator valve in said refrigerant line on said suction side of said compressor for regulating the flow of refrigerant from said third heat exchange coil so as to protect said compressor from being overloaded.

23. A method for heating an interior space of a building structure comprising the steps of:

(a) providing a solar collector for collecting and absorbing solar radiation and passing a heat transfer fluid in heat exchange relationship with said solar collector for absorbing the radiant heat therefrom to thereby heat said fluid;

(b) transferring heat from said heated fluid to said interior space when the temperature of said fluid is sufficient for satisfying the interior heating requirements;

(c) providing a first heat exchange coil in heat exchange relationship with said interior space and a second heat exchange coil in heat exchange relationship with a main heat source;

(d) providing a refrigerant flow line connecting said first and second heat exchange coils and providing a compressor having a suction side and a discharge side connected in said refrigerant flow line between said first and second coils for compressing a refrigerant contained in said refrigerant flow line;

(e) energizing said compressor when heat is required by said interior space and when the temperature of said heat transfer fluid is insufficient for heating said interior space;

(f) providing expansion means in said refrigerant flow line for expanding and evaporating refrigerant in said second heat exchange coil, said vaporized refrigerant being condensed in said first heat exchange coil for absorbing and transferring heat from said main heat source to said interior space when said compressor is energized;

(g) providing a third exchange heat exchange coil connected in parallel across said second heat exchange coil in a parallel refrigerant line and disposing said third heat exchange coil in heat exchange relationship with an auxiliary heat source;

(h) by-passing at least a part of said refrigerant through said parallel refrigerant line and said third heat exchange coil in response to the heat exchange capacity of said second heat exchange coil being reduced below a predetermined level;

(i) providing an expansion means in said parallel refrigerant line for expanding and evaporating refrigerant through said third heat exchange coil to absorb heat from said auxiliary heat source (transferring said abosrbed heat in combination with heat absorbed by said second heat exchange coil to be delivered to the suction side of said compressor.); and (j) delivering said heat absorbed in said second heat exchange coil in combination with heat absorbed in said third heat exchange in common flow to said suction side of said compressor so as to afford efficient combination and utilization of heat available in said main and auxiliary heat sources in satisfying the heating requirements of said interior space.

24. The method as set forth in claim 23 wherein said second expansion means is provided by:

(a) a partial capacity expansion means for expanding refrigerant through said third heat exchange coil and utilizing only a part of the full heat transfer capacity of said third coil in response to the heat exchange capacity of said second heat exchange coil being reduced below a first predetermined level; and (b) a full capacity expansion means for expanding refrigerant through said third exchange coil and utilizing the full heat exchange capacity of said third coil in response to the heat exchange capacity of said second heat exchange coil reduced below a seond predetermined level.

25. The method as set forth in claim 24 further comprising the step of cutting off the flow of refrigerant to said second heat exchange coil and by-passing all of the refrigerant through said third heat exchange coil when the heat exchange capacity of said second heat exchange coil drops below said second predetermined level.

26. The method as set forth in claim 23 further comprising the step of providing a pressure regulator valve in said refrigerant line on the suction side of said compressor for limiting the pressure of vapor delivered to said compressor by holding back the flow of vapor from said third heat exchange coil.

27. The method as set forth in claim 23 further comprising the step of providing a liquid injection valve in parallel across said third heat exchange coil for expanding liquid refrigerant into the discharge side of said third heat exchange coil to cool heated vapor leaving said third coil in a superheated condition.

* * * * *